US007247063B2

(12) United States Patent
Lemchen

(10) Patent No.: US 7,247,063 B2
(45) Date of Patent: Jul. 24, 2007

(54) WARNING DEVICE FOR MARINE ENGINES FOR SMALL CRAFT

(76) Inventor: Marc S. Lemchen, 553 Park Ave., New York, NY (US) 10021

( * ) Notice: Subject to any disclaimer, the term of this patent is extended or adjusted under 35 U.S.C. 154(b) by 0 days.

(21) Appl. No.: 11/212,374

(22) Filed: Aug. 25, 2005

(65) Prior Publication Data

US 2007/0049137 A1 Mar. 1, 2007

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS 6,424,267 B1 * 7/2002 Schell ..... 340/632
6,969,287 B1 * 11/2005 Motsenbocker ..... 440/1
2004/0169969 A1 * 9/2004 Takeda ..... 361/42

* cited by examiner

*Primary Examiner*—Stephen Avila
(74) *Attorney, Agent, or Firm*—Myers Dawes Andras & Sherman LLP

(57) ABSTRACT

An apparatus provides a warning of propeller rotation or $CO/CO_2$ hazard in a marine craft and includes a sensor in communication with the propeller to directly or indirectly sense rotation of the propeller and to generate a signal in response to the hazard, a controller coupled to the sensor to process the signal from the sensor, and a sensory alarm coupled to the controller to generate a warning alarm signal when the sensor returns a signal indicative of a predetermined state of hazard, namely actual rotation of the propeller from a nonzero rpm to a user or factory defined rpm or $CO/CO_2$ levels at or above a predetermined maximum.

18 Claims, 1 Drawing Sheet

WARNING DEVICE FOR MARINE ENGINES FOR SMALL CRAFT

BACKGROUND OF THE INVENTION

1. Field of the Invention

The invention relates to the field of safety devices for marine engines for small craft.

2. Description of the Prior Art

Whereas for much of the past outboards and even inboard engines in small marine craft were notoriously noisy, newer craft are being fitted with outboard engines such as the, Mercury Vorados, which are so quiet that someone swimming up to the boat, a diver or water skier, would have no idea the motor was running and could easily swim right up to a spinning prop. Even the boat operator might be unaware whether the engine was running and in particular if the propeller was spinning at idle or low speeds. Some propeller designs are such that at low engine speed or idle, very little propulsive force, if any, is provided to the craft by the spinning propeller. It would be difficult in many cases to distinguish normal drift from very slow forward motion, or the forward motion itself could be cancelled or even overcome by an opposing current or wind.

Houseboats have long had special risks in this area. Swimmers are often near them or climbing on them, they move infrequently, poor visibility of the props from the operating station, their engines are not as loud in the water as those of smaller craft, few visual indicators to swimmers the boat is about to get underway and large, slow rotating props may be more likely to draw people into them.

Many of the prior art designs to prevent prop injury have been directed to various types of cages or mechanical means which prevent a swimming from physically contacting the prop. However, these devices tend to interfere with performance and are subject to damage and are high maintenance items with the result that they are often ultimately removed or just left off when they fall off.

Some prior art devices sense the proximity of a swimmer or object near the prop and turn the engine off or cut prop rotation when the swimmer or object enters a restricted zone. However, such proximity systems are expensive, difficult to maintain under prolonged adverse environmental conditions and often unreliable.

Other kinds of marine warning or safety devices are provided to show when an engine might be running or not, but universally fail to be able to detect when the engine is actually in gear or the prop turning.

Nagakura, "Engine Control Means for Marine Propulsion," U.S. Pat. No. 4,917,061 (1990) shows an engine control means for marine propulsion. FIG. 2 is a block diagram of the system. It is noted that a control switch 28 provides an input signal to a control circuit 29. The control circuit 29 receives, in addition to the control signal from the control switch 28, a signal from an engine running sensor 31 that indicates to the control circuit 29 whether the engine is running or not. The control circuit 29, in turn, outputs control signals to the starter 18 for starting or to a kill circuit 32 for stopping of the engine 13. If desired, the control circuit 29 may also operate a display 33 which will indicate whether the engine is running or not. Nagakura's display 33 does not indicate if the engine is in gear or not when it is running, but is used only to protect the starter from being used after the engine is running.

Dyches, "Starting Apparatus For Internal Combustion Engines," U.S. Pat. No. 5,601,058 (1997) shows an apparatus for starting an engine that has an electric DC starter motor. As seen in FIG. 5, the output signal can be used by the device to de-energize the starter motor and to drive a display indicating whether the engine has started or not. In the preferred embodiment, a light or audible alarm may be employed. Again Dyches is concerned with turning a starter off once the engine is started and has nothing to do with whether the engine is in gear.

Jones, "Motor Control Circuit," U.S. Pat. No. 4,121,140 (1978) shows a motor control circuit for preventing automatic restarting of an electric motor following an interruption of electric current flow. The invention contains auxiliary components schematically indicated as 32 in FIG. 2 which normally operate simultaneously with the motor 21, such as a light, and can be used for such purposes as a light delay relay, an electrically operated brake, or a motor running indicator, etc. Jones is concerned with preventing undesired restart of an electric motor and has nothing to do with whether the engine is in gear.

Burkenpass, "Portable Helm," U.S. Pat. No. 4,739,236 (1988) describes a hand-held controller which can be plugged into multi-pin connector sockets wired at various parts of the ship. It is designed to be lightweight and compact and has a hook or hanger to facilitate stowing onto a bulkhead, and a hand grip to conveniently carry it in one hand. Idle indicator lamps are provided on the controller to verify the engine's idle status. The system can operate alone or an adjunct to existing helm systems. While idle status is indicated, Burkenpass fails to disclose whether the engine is in gear.

Suganuma, "Electrical System For Marine Outboard Drive," U.S. Pat. No. 6,446,593 (2002) shows in FIG. 6, an indicator 384 can be provided in this system and can be coupled with the ECD 214 through an indication signal line 386. The indicator 384 can indicate abnormal conditions in the power supply and additionally can indicate other data, such as various engine running conditions. There is no teaching relating to whether the engine is in gear.

What is needed is some type of warning device that overcomes each of the limitations of the prior art.

BRIEF SUMMARY OF THE INVENTION

The illustrated embodiment of the invention is generally directed to a warning device for marine engines. The illustrated embodiment contemplates an apparatus and method of using a light, flashing or otherwise, and/or some sensory warning device mounted on the engine or transom of a boat, which is activated when the boat engine is at idle or below a certain RPM, and in gear, which is visible to and positioned to warn a swimmer or someone else in the water in the vicinity of the prop of the danger.

More particularly, the illustrated embodiment of the invention is an apparatus for providing warning of propeller rotation in a marine craft comprising: a sensor in communication with the propeller to directly or indirectly sense rotation of the propeller and to generate a signal in response to the rotation of the propeller; a controller coupled to the sensor to process the signal from the sensor; and a sensory alarm coupled to the controller to generate a warning alarm signal when the sensor returns a signal indicative of a predetermined state of rotation of the propeller.

The warning alarm is arranged and configured on the craft to provide the alarm signal to persons in the water in the proximity of the propeller. The alarm signal is audible, visible and/or an underwater sonic signal.

The predetermined state of rotation of the propeller is rotation from a nonzero rpm to a user defined rpm. The alarm is automatically deactivated when propeller rotation exceeds the user defined rpm.

The alarm comprises a first alarm mounted on the craft or engine above a waterline in the proximity of the propeller. The alarm may also include at least a second alarm device mounted on the craft above a waterline in the proximity of the transom, and/or a second alarm comprised of two alarm devices, one of each mounted on the craft on the port and starboard sides, and/or a third alarm device mounted on the underwater surface.

The alarm is controllable to generate a plurality of distinguishable alarm signals.

The scope of the invention also includes a method by which such apparatus operates to provide the described warning signals.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1:
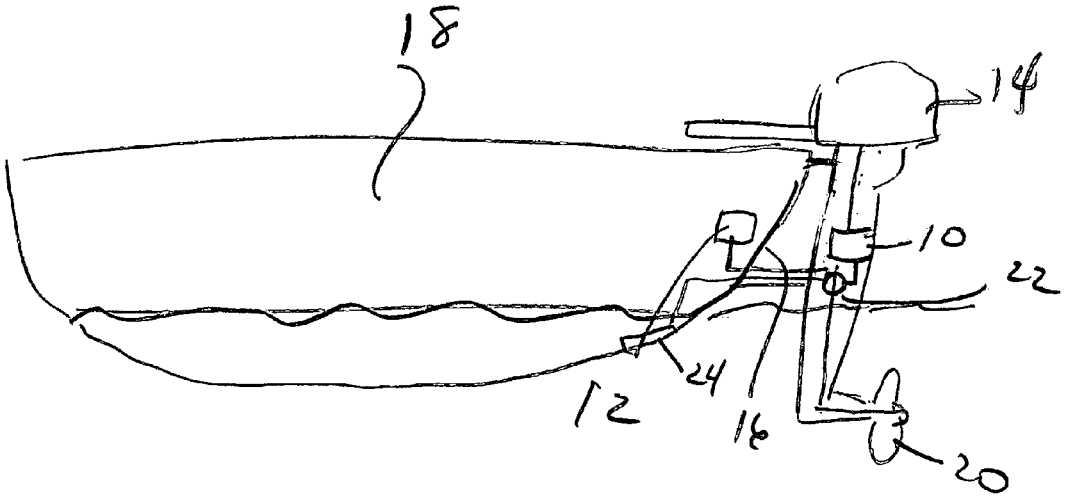
FIG. 1 is a side plan view diagram of the illustrated embodiment of the invention as realized in a marine outboard engine.
Figure 2:
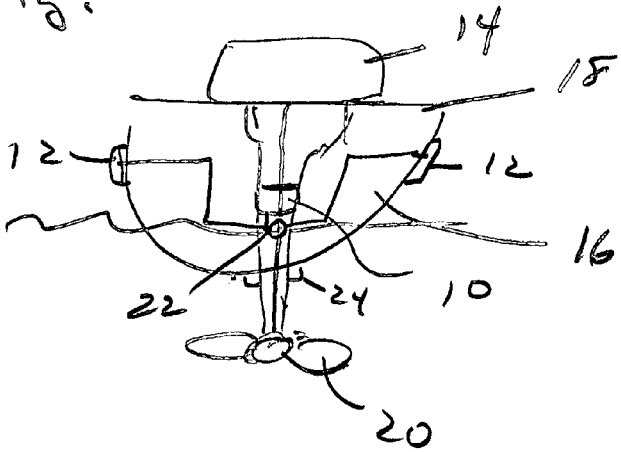
FIG. 2 is a stern plan view diagram of the illustrated embodiment of FIG. 1.

In the illustrated embodiment as depicted in the diagram of FIG. 1 a light and or sound alarm 10, 12 is mounted on the outboard motor 14 or on or near the transom 16 of a boat 18 with an inboard or stern drive, or outboard 14. An outboard is shown for the sake of simplicity in the drawings, but it is expressly understood to represent any kind of marine engine. The audible or visible warning is activated when the propeller or prop 20 is rotating from any nonzero rpm to a user defined rpm. In this way, once the boat 18 was underway and the prop or engine rpm above the user defined rpm, the light or sound of the alarm 10, 12 is automatically deactivated. Alarm 10 is shown mounted on the engine or more precisely on the engine shaft just above or in proximity to the water level so that it will be directly at eye level for a swimmer in the water. In addition, when alarm 10 provides a visible signal, it may wrap around the engine shaft to give more than a 180° viewing angle to swimmers, e.g. a 270° or more view through a plurality of windows. Alarms 12 are mounted at or near the stern of boat 18 on both port and starboard sides as best shown in the end view of FIG. 2. Again alarm 12 will be at or near the water line to allow swimmers to have a direct view. When approaching boat 18 from the bow, it might not possible for swimmers to see engine 14 or alarm 10. For this reason, alarms 12 are provided to generate a signal easily visible from any angle forward of the stern. Many different arrangements of alarms 10 and 12 can be employed without departing from the scope of the invention. For example, alarm 10 might be eliminated and alarm 12 extended around the sides and stern of boat 18 or additional hull-mounted alarms 12 placed directly on the port and starboard sides of the transom as well as the bow of boat 18. In the preferred embodiment, when a visible signal is provided by alarms 10, 12 it is a bright flashing strobe, which catches attention and is easily visible even in the brightest conditions, yet minimizes power drain on the boat's batteries or electrical system.

A sensor 22 is coupled to prop shaft, engine shaft or any moving part of the transmission or connection between the engine 14 and prop 20 or from a conventional rpm gauge provided with engine 14 (not shown). The sensor 22 could also sense the rotation of the prop 20 more directly, such as through a light or motion transducer energetically coupled to prop 20 and mounted on the engine 14 or boat 18 itself. Conventional electronics is provided in sensor 22 or in a remote control panel to detect when the signal from sensor 22 represents an rpm in excess of the user or factory selected rpm.

Additionally a light or sound alarm 24 could be placed underwater on dive boats. The device 10 would warn divers of rotating prop 20 and could be turned on to mark the boat's location as well when required. It could further act as a visual signal to divers to return to the boat when there are no other means of communication. It is contemplated that the flashing sequence and color of lights 10, 12 and 24 can be altered by control signals from the operator of boat 18 as may be desired to signify different information. For example, lights 10, 12 and 24 can be red to signify that engine 14 is running and that the prop 20 is turning and yellow to signify that engine 14 is running, but prop 20 is disengaged. Change of the color of lights 10, 12 and 24 can be implemented in a conventional manner, typically by selectively activating a light with the appropriate color filter, covering or lens.

The device 10 could be sold as a retrofitted accessory or built into the outboard engine, outdrive, or boat 18. The user could select activation range, light and or sound warnings, intensity, color and pattern of light or volume, type, pattern of the sound among a plurality of choices. It could also signal with vibration thru the water in addition to visible and audible signals. The intensity of the signal could be modified depending upon the speed of rotation of prop 20.

Device 10 be made cheaply, it is simple in construction and it address concerns with props which are not met by prior art devices. Device 10 does not affect performance of prop 20 and is not mechanically fragile.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments.

For example, while the preferred embodiment provides a sensory alarm which is dependent on actual rotation of prop 20 in a defined low rpm range, it is also possible to make the alarm signal dependent merely on whether the engine is running or not regardless of the prop condition, or whether the prop 20 is engaged to the engine or not, i.e. whether the transmission is in neutral or not.

Still further, while the invention has been described in the context of potential injury from prop 20, it is also contemplated that carbon monoxide or dioxide poisoning hazard can also be managed with the invention. There have been numerous deaths from carbon monoxide poisoning particularly on houseboats. Swimmers swim under the back of the houseboat, not realizing a generator has been running, pass out, and drown. This hazard has been conventionally addressed this by rerouting exhaust pipes, eliminating air traps or providing ventilation in the risk area. The invention can also be used to warn swimmers about possible CO or $CO_2$ accumulation in areas around the boat from generators. The same lighting system described about could include detection by a CO or $CO_2$ sensor and the same or a distinguishable warning light can be activated on detection which exceeds a predetermined maximum. A different color or flashing sequence could indicate the presence of unacceptable CO or $CO_2$ levels in an area. Even without CO or $CO_2$ detection the invention operates to inherently avoid CO hazard, if the warning lights are also connected to a generator as well as the propulsion engine, since it indicates that some kind of combustion engine is running which means that there is a potential of CO or $CO_2$ hazard, and that swimmers should stay clear.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

I claim:

1. An apparatus for providing warning of hazard to a swimmer in the proximity of a marine craft comprising:

a sensor in communication with the propeller to directly or indirectly sense rotation or possible rotation of a propeller and to generate a signal in response to the rotation;

a controller coupled to the sensor to process the signal from the sensor; and a sensory alarm coupled to the controller to generate a warning alarm signal when the sensor returns a signal indicative of rotation or possible rotation of the propeller where the warning alarm is arranged and configured on the craft to provide the alarm signal to the swimmer in the water that the propeller is rotating or possibly rotating.

2. The apparatus of claim 1 where the sensor senses an accumulation or potential accumulation of CO or $CO_2$ in excess of a predetermined maximum.

3. An apparatus for providing warning of hazard to a swimmer in the proximity of a marine craft comprising:

a sensor in communication with the propeller to directly or indirectly sense the hazard and to generate a signal in response to the hazard;

a controller coupled to the sensor to process the signal from the sensor; and a sensory alarm coupled to the controller to generate a warning alarm signal when the sensor returns a signal indicative of a predetermined state of hazard, where the alarm signal is an underwater sonic signal.

4. The apparatus of claim 1 where the controller generates the signal when the propeller is rotating between nonzero rpm and user defined rpm.

5. The apparatus of claim 4 where the alarm is automatically deactivated when propeller rotation exceeds the user defined rpm.

6. The apparatus of claim 1 where the alarm comprises a first alarm mounted on the craft or engine above a waterline in the proximity of the hazard.

7. An apparatus for providing warning of hazard to a swimmer in the proximity of a marine craft comprising:

a sensor in communication with the propeller to directly or indirectly sense the hazard and to generate a signal in response to the hazard;

a controller coupled to the sensor to process the signal from the sensor; and a sensory alarm coupled to the controller to generate a warning alarm signal when the sensor returns a signal indicative of a predetermined state of hazard, where the craft has a transom and where the alarm comprises a second alarm mounted on the craft above a waterline in the proximity of the transom.

8. The apparatus of claim 7 where the craft has port and starboard sides and where the second alarm is comprised of two alarm devices, one of each mounted on the craft on the port and starboard sides.

9. An apparatus for providing warning of hazard to a swimmer in the proximity of a marine craft comprising:

a sensor in communication with the propeller to directly or indirectly sense the hazard and to generate a signal in response to the hazard;

a controller coupled to the sensor to process the signal from the sensor; and a sensory alarm coupled to the controller to generate a warning alarm signal when the sensor returns a signal indicative of a predetermined state of hazard, where the craft has an underwater surface and where the alarm is mounted on the underwater surface.

10. The apparatus of claim 1 where the alarm is controllable to generate a plurality of distinguishable alarm signals.

11. A method for providing warning of a rotation or possibly hazardous rotation of a propeller on a marine craft comprising:

sensing the rotation or possible rotation of the propeller;

generating a signal in response to the rotation or possible rotation of propeller; and generating a sensory alarm to provide a warning alarm signal when rotation or possible rotation of the propeller exists, where the warning alarm signal is arranged and configured on the craft to provide the alarm signal to a person in the water that the propeller is rotating or possibly rotating.

12. A method for providing warning of a hazard in the proximity of a marine craft comprising:

sensing the hazard;

generating a signal in response to the hazard; and generating a sensory alarm to provide a warning alarm signal when a predetermined state of the hazard exists, where generating the sensory alarm comprises generating an underwater sonic signal.

13. The method of claim 11 where the hazard is rotation of a propeller and where generating the sensory alarm comprises generating a warning signal when the propeller is rotation from a nonzero rpm to a user defined rpm.

14. The method of claim 13 further comprising automatically deactivating the alarm when propeller rotation exceeds the user defined rpm.

15. A method for providing warning of a hazard in the proximity of a marine craft comprising:

sensing the hazard;

generating a signal in response to the hazard; and generating a sensory alarm to provide a warning alarm signal when a predetermined state of the hazard exists.

where generating the sensory alarm comprises generating an underwater signal.

16. The method of claim 11 where generating the sensory alarm comprises generating a plurality of distinguishable alarm signals.

17. The method of claim 15 where sensing the hazard further comprises sensing a CO or $CO_2$ concentration level at or above a predetermined maximum.

18. An apparatus for providing warning of a CO or $CO_2$ hazard to a swimmer in the proximity of a marine engine comprising:

a sensor in communication with a waterline region in proximity to the marine engine to directly or indirectly monitor a CO or $CO_2$ concentration and to generate a signal in response to the concentration;

a controller coupled to the sensor to process the signal from the sensor; and a sensory alarm coupled to the controller to generate a warning alarm signal when the sensor returns a signal indicative of a CO or $CO_2$ concentration beyond a predetermined threshold, where the warning alarm is arranged and configured to provide the alarm signal to a swimmer in the water, who is or might enter the monitored waterline region.

* * * * *